United States Patent [19]

Mollerus

[11] Patent Number: 4,633,685

[45] Date of Patent: Jan. 6, 1987

[54] APPARATUS FOR DEWATERING WET LAUNDRY

[76] Inventor: Alexander Mollerus, Friedhofstrasse 13,, D-7128 Lauffen, Fed. Rep. of Germany

[21] Appl. No.: 721,432

[22] Filed: Apr. 9, 1985

[30] Foreign Application Priority Data

Apr. 9, 1984 [DE] Fed. Rep. of Germany ..... 3413309

[51] Int. Cl.[4] ..... D06F 47/06

[52] U.S. Cl. ..... 68/242; 100/116; 100/211; 100/221

[58] Field of Search ..... 68/21, 241, 242; 100/116, 125, 211, 221

[56] References Cited

U.S. PATENT DOCUMENTS 1,034,207 7/1912 Corbett ..... 100/125
3,992,905 11/1976 Oberley et al. ..... 68/241
4,249,400 2/1981 Arendt ..... 68/242

FOREIGN PATENT DOCUMENTS 60420 9/1982 European Pat. Off. ..... 68/242

*Primary Examiner*—Philip R. Coe
*Attorney, Agent, or Firm*—Schwartz, Jeffery, Schwaab, Mack, Blumenthal & Evans

[57] ABSTRACT

Apparatus for dewatering wet laundry comprising a base with drain openings for discharging water pressed out of the laundry, a loose cylinder disposed on the base, a bell disposable on the cylinder with a flexible membrane therein defining with the bell a chamber for a pressure medium and a plurality of rods supported on a lifting apparatus and extensible through openings through the peripheral margin of the bell, through annular flanges on the cylinder and through aligned openings in the base. The rods are provided with locking elements and are pivotable to latch the base, cylinder and bell securely together as well as serving to selectively lift the cylinder and bell or just the bell to facilitate loading and unloading of the apparatus.

11 Claims, 6 Drawing Figures

APPARATUS FOR DEWATERING WET LAUNDRY

BACKGROUND OF THE INVENTION

The present invention relates to an apparatus for dewatering wet laundry. Known devices of this type consist of a base plate with water drain openings and a bell mounted on a frame with an elastic membrane therein which claps over wet laundry deposited on the base plate. The wall of the bell encloses the laundry. By forcing a fluid pressure medium into the space in the bell above the membrane, the membrane is urged against the laundry and presses excess moisture out of it. The forces which thereby arise are transmitted by the frame on which the bell is mounted to the foundation under the press. This arrangement is very expensive to construct. Furthermore, because of the way the apparatus is constructed, this process can only be carried out in discontinuous fashion.

SUMMARY OF THE INVENTION

It is the object of the present invention to provide an apparatus for dewatering wet laundry which has a simpler construction.

Another object of the present invention is to provide an apparatus for dewatering wet laundry which, with the use of an intervening cycle, enables the interruption time between cycles to be shortened.

A further object of the present invention is to provide an apparatus for dewatering wet laundry which enables a greater throughput to be processed.

These objects are achieved by providing an apparatus for dewatering wet laundry comprising a membrane arranged in a domed lid or bell so as to be subjected to the force of a pressure fluid and a base disposed thereunder with drain outlets therein for discharging water pressed out of the laundry, wherein a loose cylinder separate from the bell having upper and lower marginal flanges and disposable on said base, and a lifting apparatus for selectively lifting the cylinder and the bell or just the bell, said lifting apparatus comprising a plurality of rods with lacking elements which simultaneously function as a latching mechanism and aligned openings in the peripheral margin of the bell, in the marginal flanges of the cylinder and in the base which are spaced from each other and distributed around the circumference of the cylinder; each said rod being extendable through aligned openings in the peripheral margins of the bell, the flanges of the cylinder and the base and when rotated positively locking the bell, cylinder and base to each other in a releasable fashion.

In the apparatus of the invention, the forces exerted by the pressure fluid are received entirely by the thusly arranged elements of the apparatus. A portal construction anchored in the foundation or a dispersal of the forces in the side wall while taking into account the higher bending moments is avoided.

The entire operation of loading, pressing and unloading is capable of being automated. The manner of operation is very simple. The cylinder which receives the laundry is loosely disposed on the base having the water outlets or drain openings. After laoding the wet laundry into the cylinder, the rods, with their latching elements, which carry the bell with its membrane are lowered until the bell lies with its peripheral margin on the upper cylinder flange.

The rods are then unlatched from the bell and lowered further through the openings found in the flanges of the cylinder and through the corresponding openings in the base, and then relatched with the bell as well as with the base. Thus the rods which extend directly adjacent the cylinder receive the entire force which arises.

The latching may be effected by screwing the rod into the peripheral margin of the bell, into the lower flange of the cylinder and into the base, whereby upon closing a simultaneous engagement of two segments of threads on the rod is required.

Upon release and opening of the press, the threads are turned out of the base but remain engaged with the lower flange of the cylinder. The cylinder can thus be lifted with the bell by the rods, and the press dewatered wash can be removed. Thereafter, the cylinder is lowered again, and the rods are unscrewed further until they are released from the lower cylinder flange. The lower threaded segment on each rod is lifted up and screwed into the margin of the bell so that the bell can be lifted for refilling of the cylinder.

If the threads on the rods are appropriately designed, the rods need only be rotated a few turns in the locking and ulocking process. Additionally, the openings which are free of threads must have a larger diameter than the threads.

A much simpler possibility for latching the parts together is to design the openings as elongated openings and to provide the rods with crossbars, which must be arranged at the bottom and in an upper region in such a way that they may simultaneously engage the bottom of the base and the top of the upper peripheral margin of the bell.

The number of the rods and their diameter are determined by the desired tensile strength or pressure resistance of the arrangement and by a uniform distribution of the forces around the peripheral margin of the bell and the base. By use of the crossbars on the rods, a rotation of 90° from the position in which the rods pass through the openings in the cylinder flanges and the base is sufficient to effect locking. An arrangement of upper and lower annular flanges around the cylinder is preferred in order to enable achievement of a rigid connection since in this way pairs of engaging members are provided both at the top and at the bottom of the cylinder: bell/upper flange on the one hand, and base/-lower flange on the other hand.

The elongated openings are thereby preferably oriented tangentially to the circumference of the cylinder. The crossbars themselves may extend from the rods, which preferably are round, on only one side (L-formed) or on both sides (T-formed). A space should be left between the lower edge of the bell and the upper edge of the upper flange of the cylinder for receiving the crossbar.

It is particularly advantageous to rotatably mount and rods in a common framework, for example, a support plate so that they can be lowered and latched or unlatched and raised together. In such an arrangement a common drive mechanism can be provided to effect simultaneous rotation of the rods. For example, this is possible by use of a central gear wheel engaged by another gear wheel associated with each rod, or at suitably low gear ratios, by toothed wheel segments which do not need to extend beyond the margin of the plate.

A particular advantage of the present invention is that two stations can be operated in a "carousel" operation. This is achieved in a simple manner by using two drain opening containing base segments which are pivotable about a common axis between a loading position and an unloading position as well as individual cylinders, bells, rods with locking elements and support frames for raising and lowering of the cylinders and/or bells, arranged above each base segment. The support frames are preferably designed to be drivably pivotable synchronously with the base segments about the axis.

The manner of operation of the device is as follows. After the loading and pressing operations, or during the pressing operation, a selected cylinder together with its bell and base segment is pivoted by 180°. Thereby an empty second cylinder on the other base segment is pivoted into the loading position. The bell of the second cylinder is raised by the rods so that the cylinder can be loaded. The bell is lowered again onto the top of the loaded cylinder, and the rods are extended through the openings in the cylinder flanges and in the base and pivoted to shift the crossbars to the latched position underneath the base. A pressure fluid, such as water, is then pumped into the space between the bell and the membrane to force the membrane against the wet laundry and press out excess water. After the pressing operation is completed, the crossbars are released from the base segment, moved to a position beneath the lower flange of the cylinder and again brought to the latched position. The rods are then lifted carrying the cylinder and bell together with them until the press-dewatered laundry can be pushed onto an adjacently disposed conveyor. Thereafter, the assembly is lowered again to the base segment, the rods are released and raised to a position beneath the peripheral margin of the bell. The rods are again moved to the latched position, and they lift the bell a sufficient distance for the cylinder to be loaded. This may occur, for example, during pivoting back to the loading position. After loading of a new batch of wet laundry, a new cycle begins. Since the loading and/or the pressing can be carried out simultaneously with other operations, shorter cycle times can be achieved according to the invention.

In accordance with the present invention and within its scope, it is naturally possible to utilize more than two containers in carousel operation since basically only the cylinders and bells have to be moved around the circle with the carousel, but not the rods and the lifting apparatus.

The loading of the apparatus can be facilitated by use of an extensible and retractable loading hopper disposed underneath the laundry outlet of the washing machine. The hopper is extended over the cylinder during loading and then retracted before the lowering of the bell.

The press-dewatered laundry can be transferred with the aid of a pusher or slide to a conveyor belt disposed adjacent the unloading position.

BRIEF DESCRIPTION OF THE DRAWINGS

The invention will be described in further detail with reference to the accompanying drawings wherein.

DETAILED DESCRIPTION OF PREFERRED EMBODIMEMTS

Figure 1:
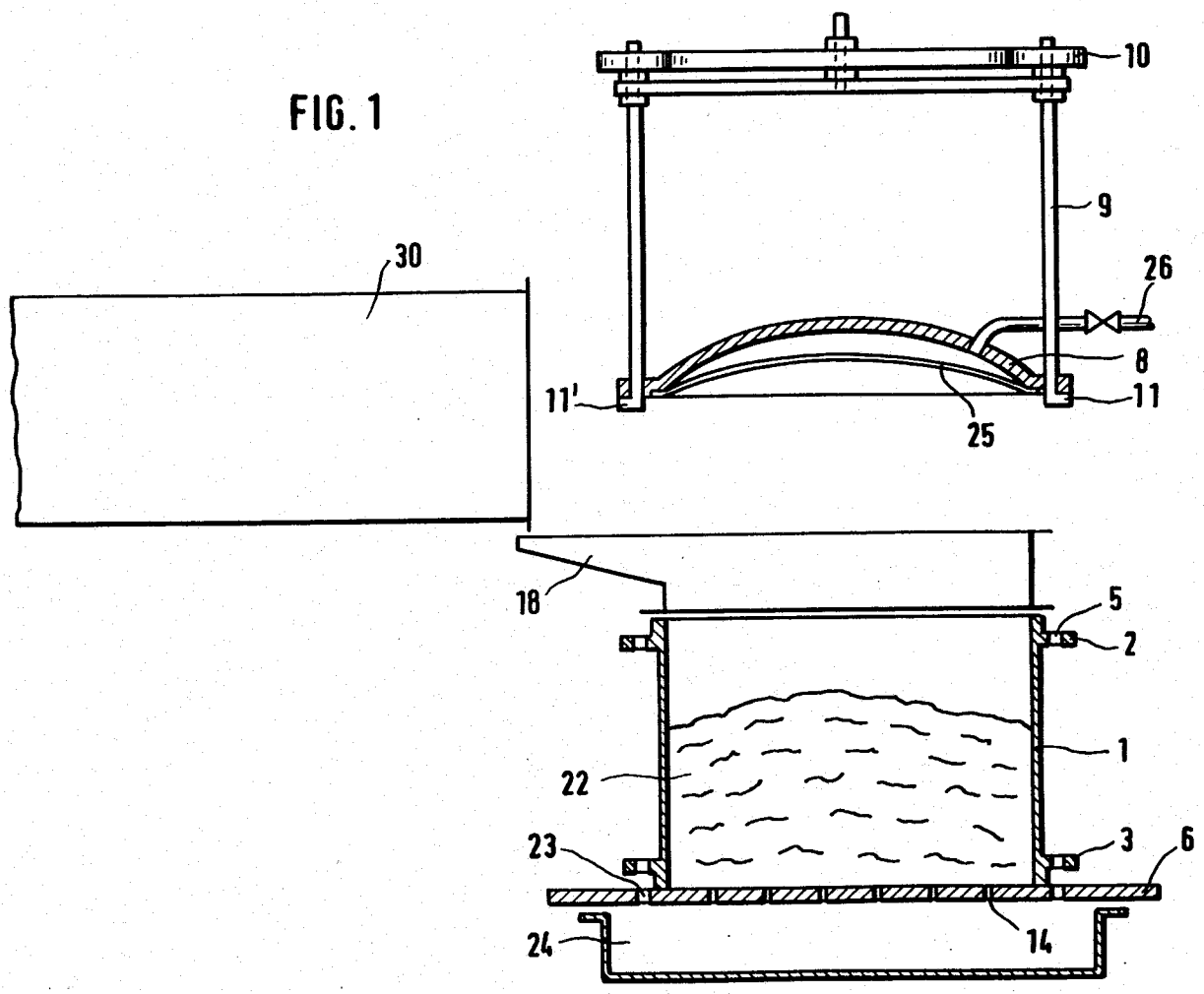
FIG. 1 shows the apparatus of the invention in the loading position.

FIG. 1 shows a cylinder 1 loaded with wet laundry 22. The cylinder rests upon a base 6 with drain openings or water outlets 14 through which the free liquid or liquid which has been pressed out of the laundry can be discharged. This base may also be referred to as a "sieve" base.

Upper and lower annular flanges 2 and 3 are arranged on the sides of cylinder 1. The flanges are provided with through openings 5. The base 6 is also provided with similar openings 23 coaxially aligned with the openings in the cylinder flanges. Underneath the base there is a tub 24 for collecting the water which is discharged. The washing machine outlet 30 is shown at the left of the drawing.

A domed lid or bell 8 with a flexible membrane 25 and a connection 26 for the pressure medium is disposed above the cylinder.

A plurality of rods 9 with crossbars 11 and 11' hang from a frame or support plate 10. The rods are rotatably mounted and are motor driven by means of a gear drive.

The laundry is introduced into the cylinder through the displaceable loading hopper 18.

Figure 2:
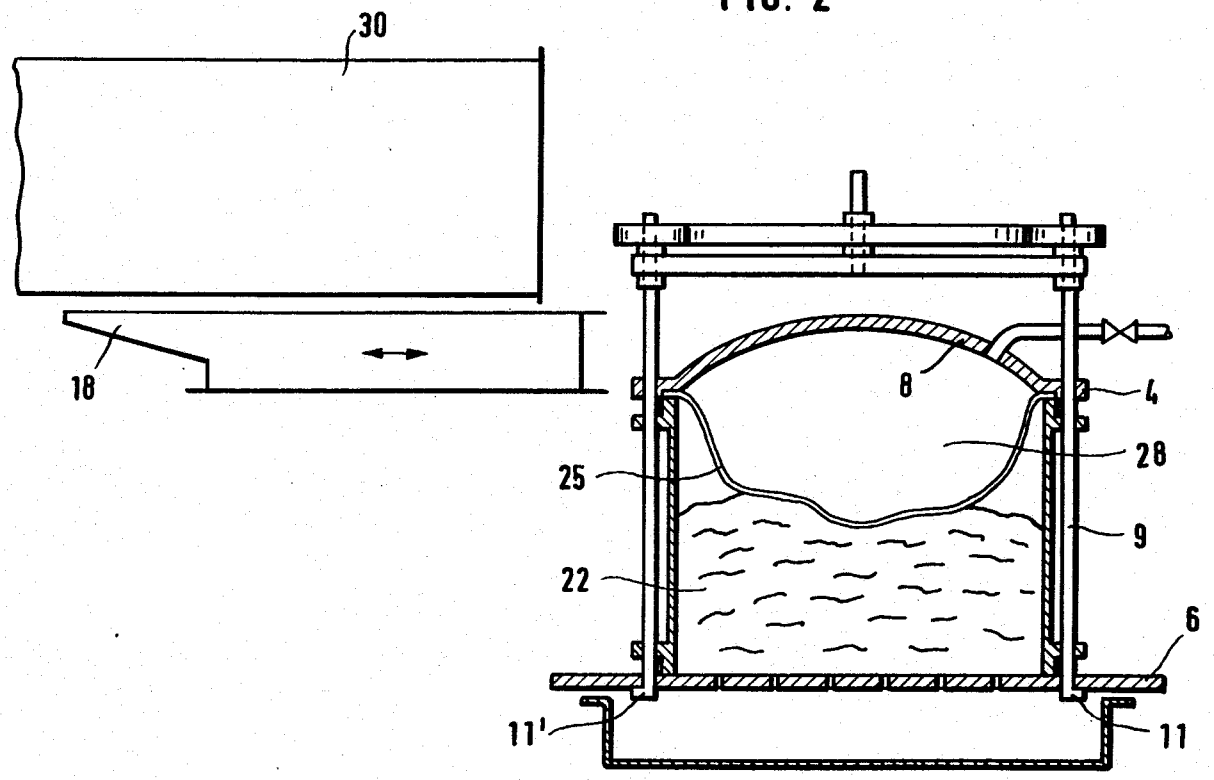
FIG. 2 shows the apparatus of the invention during pressing of excess water out of the wet laundry.

FIG. 2 shows the cylinder 1 in the closed condition in which the crossbars 11 and 11' hold the cylinder 1 securely between the bell 8 and the base 6. The loading hopper 18 is retracted to the side. The membrane 25 is subjected to the pressure of water 28 introduced into the chamber between the bell and the membrane, whereby the membrane 25 is forced against the wet laundry, and the excess liquid is pressed out of the laundry.

Figure 3:
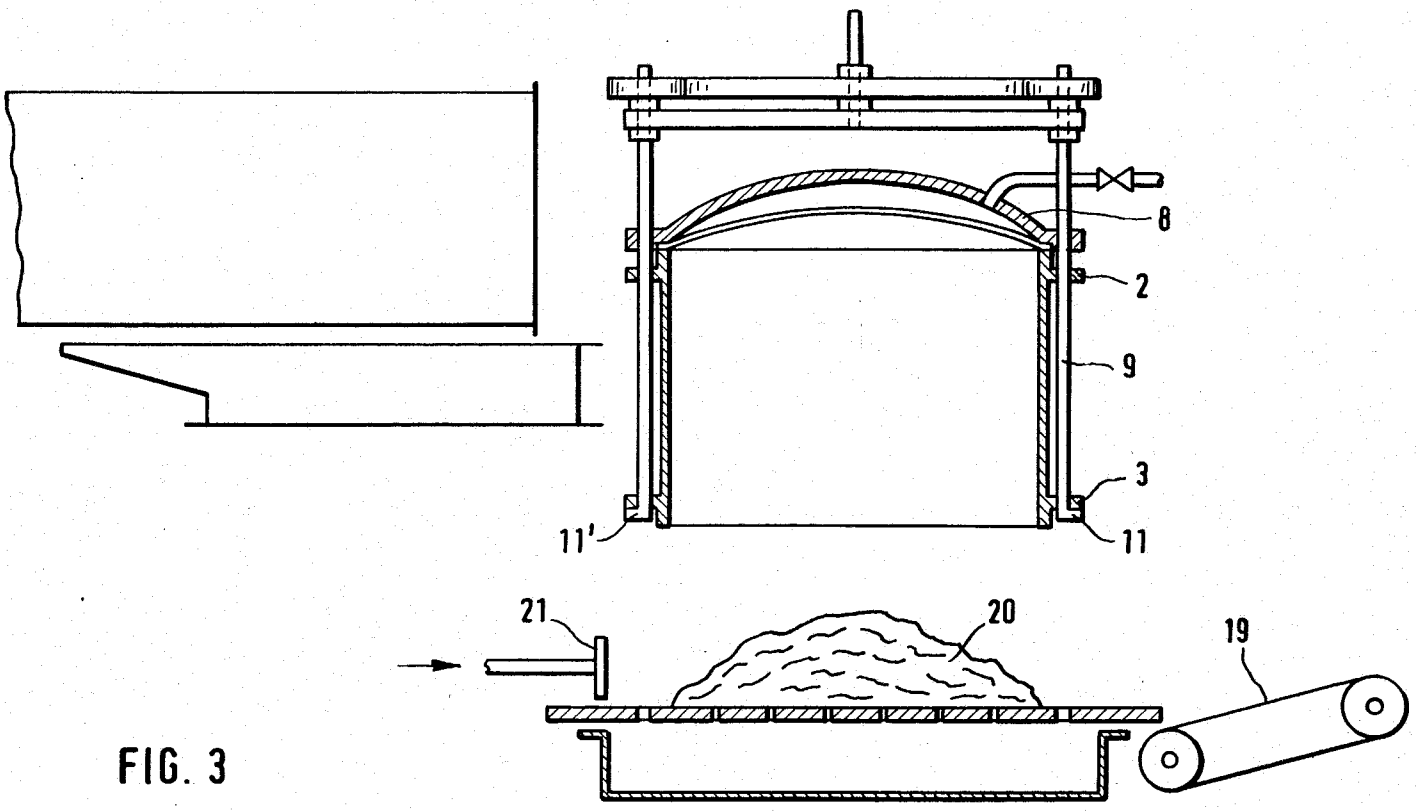
FIG. 3 shows the removal of the press-dewatered laundry.

FIG. 3 shows how the cylinder 1 is lifted together with the bell 8. The water pressure medium is withdrawn from the chamber between the bell and the membrane either prior to or during the lifting of the cylinder and bell assembly. The crossbars 11' of the rods 9 are disposed underneath the lower flanges 3 of cylinder 1. However, they could also be positioned underneath the upper flanges 2 for lifting the cylinder. The slide 21 pushes the press-dewatered laundry onto a conveyor belt 19 which conveys it to the final drying.

Figure 4:
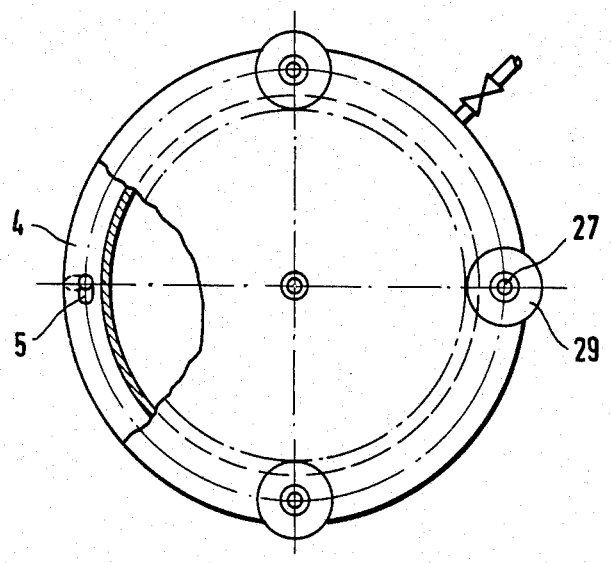
FIG. 4 is a plan view of the latching mechanism.

FIG. 4 shows a plan view of the latching and release mechanism utilizing a gear drive 26, 27 in which the smaller gear wheels 27 turn the rods 9. A small gear reduction ratio is possible without the gear wheels 27 which are connected to the rods 9 projecting greatly beyond the margin of the cylinder 1 if wheel segments having the form of circular segments with large radii are utilized. However, then the rods can only pivot back and forth and cannot be completely rotated.

Further, in FIG. 4, one of the elongated openings 5 in the peripheral margin of the bell 4 can be seen. Likewise, an L-shaped crossbar pivoted into the latched position underneath the peripheral margin of the bell is shown in broken lines. A motor (not shown) powers the gear drive. If desired, the motor can be operated at prescribed time intervals determined by a program control device which also may be used to regulate the cyclic operation of a lifting apparatus (not shown).

Figure 5:
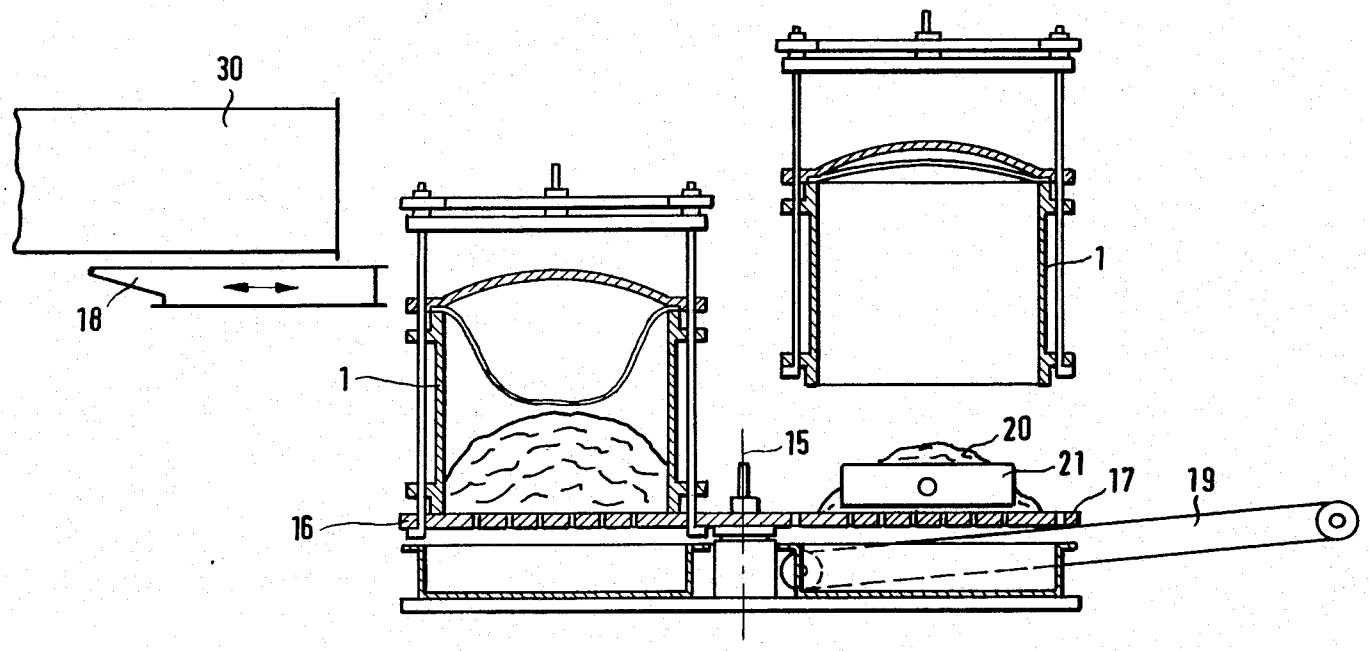
FIG. 5 shows a carousel arrangement.

FIG. 5 shows two cylinders 1 in a carousel arrangement wherein the left cylinder (which rests upon and is locked to a base segment 16) is being subject to the pressure of a water pressure medium. Left base segment 16 and right base segment 17 are mounted to pivot about a common axis 15 and are motor driven.

The right cylinder is lifted, so that the press-dewatered laundry 22 can be discharged by the action of a slide 21 onto the conveyor belt 19. The representation of the cylinder in the raised position corresponds to the arrangement illustrated in FIG. 3.

Figure 6:
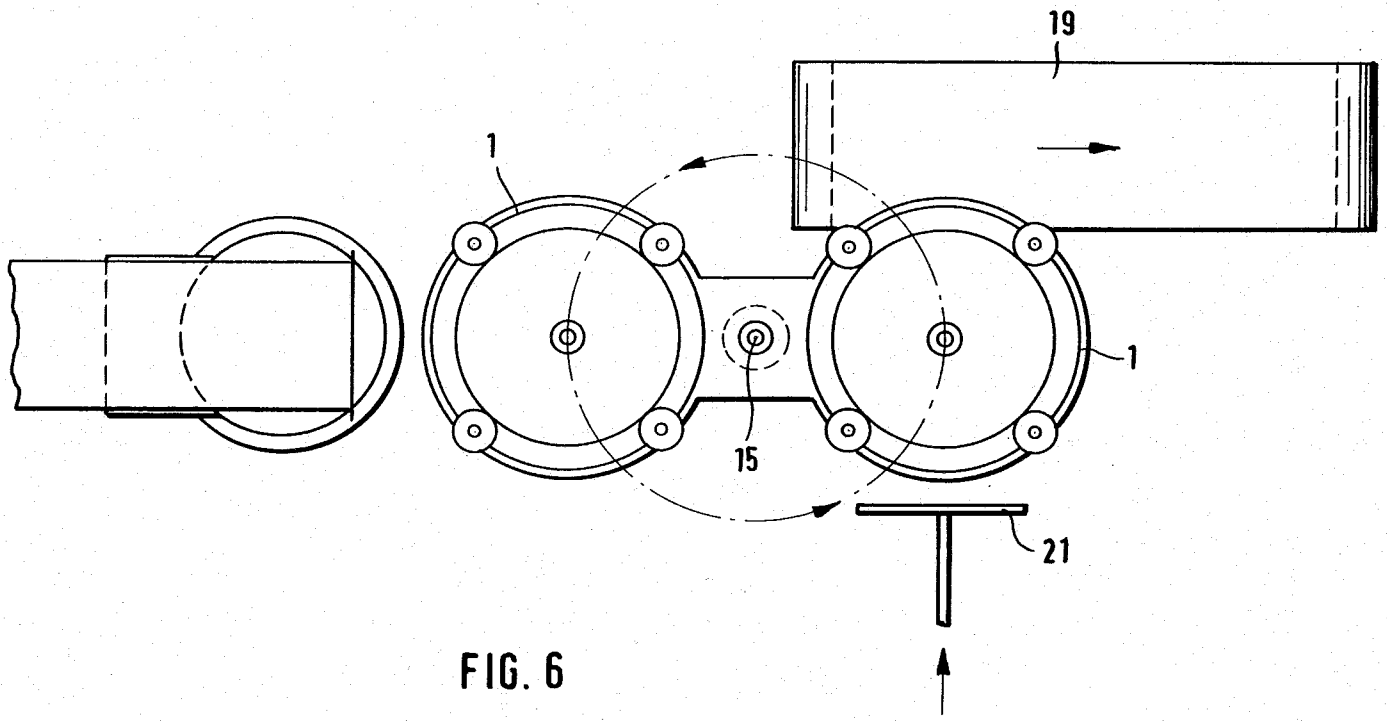
FIG. 6 is a plan view of the carousel arrangement of FIG. 5.

FIG. 6 shows a plan view of the carousel arrangement of FIG. 5. In the Figure, the left and right gear drives 26 and 27 can be seen as well as the pivot axis 15. The slide 21 and the conveyor belt 19 can be seen in the drawing adjacent the right gear drive. At the left of the drawing are the washing machine outlet 30 and the retracted loading hopper 18 which is disposed underneath the washing machine outlet in a direction perpendicular to the plane of the paper.

The foregoing embodiments have been described merely to illustrate the invention and are not intended to be limiting. Since modifications of the disclosed embodiments incorporating the spirit and substance of the invention may occur to persons skilled in the art, the scope of the invention is to be limited solely with respect to the appended claims and equivalents.

What is claimed is:

1. Apparatus for dewatering wet laundry comprising:

a base having drain outlets therein;

a loose cylinder having at least one annular flanges therearound, said cylinder being disposable on said base about said drain outlets;

a bell having an open end and a peripheral margin therearound, said bell being disposable with its open end on said cylinder;

a membrane arranged in said bell across said open end;

means for introducing a pressure fluid into said bell to force said membrane out said open end of said bell; and means for selectively lifting said cylinder and said bell or just said bell and for latching said bell, cylinder and base together in releasably fashion, said lifting and latching means comprising:

a plurality of sets of aligned openings distributed around said bell, cylinder and base, each set of aligned openings comprising an opening through the peripheral margin of said bell, an opening through a flange of said cylinder, and an opening through said base; and a plurality of rotatable rods each of which can be extended through a set of aligned openings when said cylinder is disposed on said base and said bell is disposed on said cylinder, each rod having a locking element thereon;

whereby when the cylinder is disposed on the base, the bell is disposed on the cylinder and the rods are extended through the aligned openings, the rods and locking elements can be rotated to latch the bell, cylinder and base together, and pressure fluid can be introduced into the bell to force the membrane against laundry disposed on the base inside the cylinder and press water out of the laundry.

2. Apparatus according to claim 1, wherein the locking elements comprise upper and lower crossbars on said rods and the aligned openings are elongated openings, and wherein the crossbars are disposed on top of the peripheral margin of the bell and underneath the base when said bell, cylinder and base are latched.

3. Apparatus according to claim 2, wherein a space is provided for the crossbars between an upper edge of an upper flange of the cylinder and a lower edge of the peripheral margin of the bell for lifting the bell.

4. Apparatus according to claim 1, wherein the rods are mounted on a common supporting frame and are raisable and lowerable together with the frame.

5. Apparatus according to claim 1, further comprising a common drive mechanism for rotating all of the rods.

6. Apparatus according to claim 5, wherein said common drive mechanism comprises a gear drive.

7. Apparatus according to claim 1, comprising two base segments pivotable about a common axis between a loading position and a discharge position, and wherein an individual cylinder, bell and set of rods with locking elements and a support frame for selectively raising and lowering the cylinder and the bell are provided for each base segment.

8. Apparatus according to claim 7, wherein the support frames and base segments are synchronously pivotable about said axis.

9. Apparatus according to claim 7, further comprising a loading hopper which is extensible to a position above a cylinder in the loading position.

10. Apparatus according to claim 7, further comprising a conveyor disposed adjacent said discharge position and means for discharging laundry from a base segment in said discharge position onto said conveyor.

11. Apparatus according to claim 10, wherein said discharging means comprise a slide for pushing the laundry from said base segment onto said conveyor.

* * * * *